US005963137A

United States Patent [19]

Waters, Sr.

[11] Patent Number: 5,963,137

[45] Date of Patent: Oct. 5, 1999

[54] ALARM DEVICE FOR MONITORING AN INDIVIDUAL'S MOVEMENT AND/OR NEED FOR ASSISTANCE

[76] Inventor: Joe Cleveland Waters, Sr., 104 W. Lynne Dr., Martinez, Ga. 30907

[21] Appl. No.: 09/021,484

[22] Filed: Feb. 10, 1998

[51] Int. Cl.[6] ..... G08B 23/00

[52] U.S. Cl. ..... 340/573.4; 340/573.1; 340/286.07; 340/547; 200/61.45 M

[58] Field of Search ..... 340/573.1, 574, 340/568.1, 540, 571, 286.07, 547; 200/64.45 M, 61.58; 335/268

[56] References Cited

U.S. PATENT DOCUMENTS

| | | | |
|---|---|---|---|
| 4,577,185 | 3/1986 | Andersen | 340/573 |
| 4,583,084 | 4/1986 | Henderson et al. | 340/573 |
| 4,638,307 | 1/1987 | Swartout | 340/573 |
| 4,780,704 | 10/1988 | Tommasini | 340/568 |
| 5,066,943 | 11/1991 | Demirel et al. | 340/573 |
| 5,210,532 | 5/1993 | Knoedler et al. | 340/573 |
| 5,494,046 | 2/1996 | Cross | 340/573 |

*Primary Examiner*—Daniel J. Wu
*Assistant Examiner*—Anh La

[57] ABSTRACT

An audible, visual, and remote alarm system designed to monitor the status of a person in another room to know when assistance or attention may be needed; thereby, reducing or alleviating the caregiver's dilemma of being tethered to a very small area. The persons being monitored may include the elderly, Alzheimer patients, sleep walkers, and others who may be at risk by getting out of the chair, or off the bed without assistance and may not be able to rationalize the need to summon help. The system is also suitable for monitoring individuals who can consciously summon assistance by activating a magnetic switch. Primarily designed for use in private homes as a stand-alone system, this system can also be used to augment permanent call cord systems in hospitals, nursing homes, and residential facilities. An optional remote activator switch and wireless audible chime and visual indicator (light) is provided as a part of the alarm device that can be integrated to augment the alarm device to allow the caregiver to monitor an individual from a further distance. By using the wireless chime device, the caregiver can move about freely in the yard or garden while carrying the device on his/her person. Because it is powered by 9 volt battery's, the system is very flexible and portable to give the individual being monitored and caregiver both a better quality of life, as it allows for visitation to other places, homes, hotels and even campers or cruise ships.

9 Claims, 6 Drawing Sheets

ALARM DEVICE FOR MONITORING AN INDIVIDUAL'S MOVEMENT AND/OR NEED FOR ASSISTANCE

CROSSREFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates to audible and visual alarm systems that are used to monitor the status of a person in another room for a variety of reasons to know when assistance or attention may be needed.

A caregiver's dilemma is that he or she is often tethered to a very small area and close range due to the constant demands of the one for whom they are caring. If the caregiver has to leave the room of the one for whom they are caring for a brief or extended period of time, they often become extremely anxious and worrisome about the individual trying to get off the bed without assistance or needing some other kind of assistance. There are numerous examples where an alarm device would be beneficial.

The first typical example for the need to monitor the status of a person in another room is that of an elderly person. Elderly people are usually insistent on remaining independent when it comes to personal care issues and consequently, this often places them at risk. Elderly people are often too frail to get up and out of bed without assistance. Getting out of bed without assistance can result in serious injury to them—perhaps, a broken hip or becoming entangled in a bedside rail. Elderly people very often have to get up several times during the night thereby depriving the caregiver of necessary rest.

A second example involves Alzheimer patients who require close monitoring. Alzheimer patients tend to wander out of bed and sometimes unknowingly even leave the premises. Other family members often do not know that the individual has gotten out of bed until after they have left home and become missing.

A third example involves individuals who sleep walk. Other family members are sometimes unaware that their sleepwalker has gotten out of bed and perhaps has left the premises and placed themselves in extreme danger.

Caregivers have difficulty relaxing or sleeping, as they are aware of dangers posed by the three (3) examples above. There are presently no alarm devices that adequately alert caregivers to the needs of such individuals and the potential dangers they experience from such activity.

Currently, patient call cord systems with buttons or switches are available in nursing homes, hospitals, and some residential care facilities. Call cords are not effective to monitor the three examples listed above. The reason traditional call cords are not effective in these cases is because the systems require one, to a large degree, to be coherent, alert, and able to contemplate and enunciate his or her need for assistance. This system can be effectively utilized parallel to the traditional call systems in nursing homes, hospitals, and residential care facilities to rectify this unmet monitoring need.

Unlike traditional call systems, this invention automatically alerts the caregiver by audible and visual alarm signals when the patient being monitored attempts to leave the bed, chair or other location where he or she may be situated. Additionally, the individual being monitored can consciously summons assistance by simply pulling on the alarm's connecting apparatus.

Institutional type call systems are not normally available in private homes and even if these type systems were available, it would not meet the needs described herein.

BRIEF SUMMARY OF THE INVENTION

My newly invented audible and visual alarm system is predicated on the fact that individuals who require assistance do not have to consciously anticipate his or her needs, that is, they are not required to contemplate the need to call for assistance. This system, however, can be effectively and conveniently utilized by an individual being monitored to consciously summons assistance by the individual simply pulling on the alarm's connecting apparatus that activates the magnetic switch.

My alarm system utilizes newly designed parts in combination with some basic materials and products that are currently available in the market place to achieve a uniquely designed and workable invention.

The basic materials utilized in this invention include: One (1) set of electrical magnetic switches (14, FIG. 3). Two (2) nine (9) volt DC batteries (17C, FIG. 8); Low voltage electrical wire (15, FIG. 1) in sufficient length to connect by hardwire the magnetic switch (14) to the audible and visual alarms (17,17A,17B) illustrated in (FIGS. 1,5,8,9); Two (2) or more electronic pulsating buzzers (17B); Three (3) low voltage colored light bulbs (17A); One (1) four (4) centimeters by eight (8) centimeters strip of male and female Velcro (14B); One (1) standard remote wireless audible door chime system comprising an activator switch (16 ) and a remote wireless audible door chime (18, FIG. 1) which is modified to include the installation of a visual alarm indicator light (17A, FIG. 11), plus an adapter clip (18A,18B, FIG. 12) which permits the caregiver to conveniently attach the remote wireless door chime device to his/her belt or clothing (18, FIG. 1) while monitoring someone remotely; A connecting strap (13A, FIG. 1) which links the person being monitored to the magnetic switch (14, FIG. 1) with said connecting strap being designed utilizing materials from standard clothing suspenders, specifically; two (2) adjustable clasps (13B, FIG. 2), and a fastener (13, FIG. 2). A newly invented and designed T Hook (13C, FIG. 4) that is connected on one end to the strap (13A, FIG. 2) and the two ends of the T Hook (13C, FIG. 3) are inserted into the two holes drilled into the modified magnetic switch cover (14A, FIG. 3).

BRIEF DESCRIPTION OF SEVERAL VIEWS OF THE DRAWING

Preferred embodiments of the present invention will now be described in greater detail and will be better understood when read in conjunction with the following drawings in which:

FIG. 11 is a circuit diagram showing the modification of a standard wireless remote audible door chime device to which a light bulb has been added and hardwired to the positive and negative speaker connections.

DETAILED DESCRIPTON OF THE INVENTION

The audible and visual alarm system of the present invention illustrated in the perspective view (FIG. 1) is activated by forward or side movement of the individual being monitored which causes the connecting strap (13A) to separate the two sides of the magnetic switch (14). The connecting strap (13A) is fitted on one end to the person being monitored by a standard clothing suspender fastener (13) and fitted on the other end to the magnetic switch (14A) by my newly invented T Hook (13C). The connecting strap (13A) is made of non-elastic cloth, plastic, or other material and is adjustable to a suitable length by using two- (2) standard clothing suspender adjustment clasps (13B).

Figure 7:
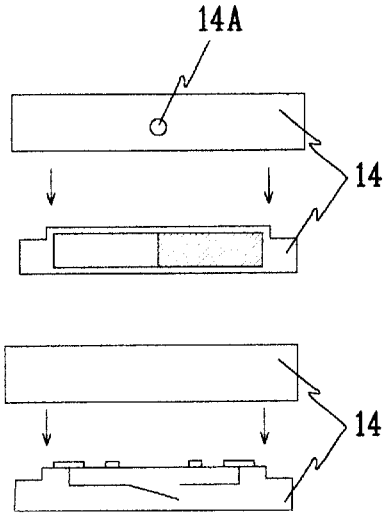
FIG. 7 is a detail view of the magnetic switch showing internal wiring features and external covers.
Figure 8:
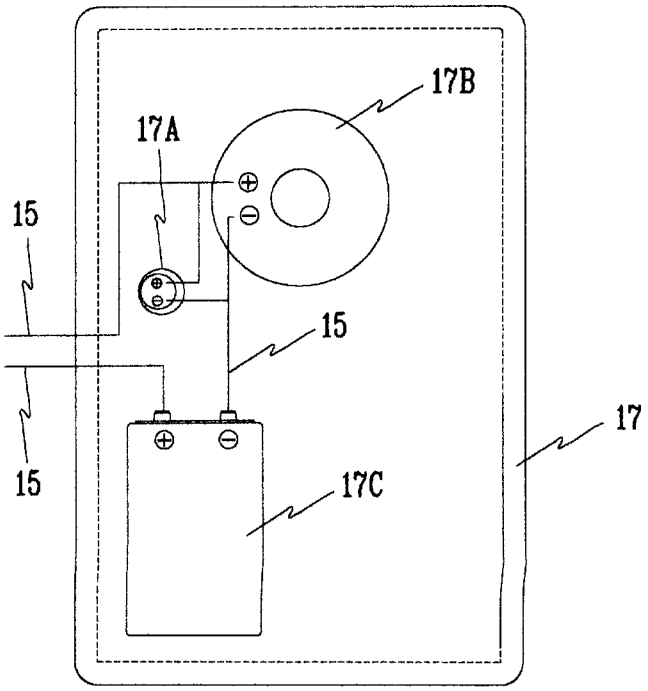
FIG. 8 is a circuit diagram of the hardwired audible and visual alarm showing a nine (9) volt DC battery power supply, low voltage wire, a light bulb, and an electronic audible pulsating buzzer.
Figure 9:
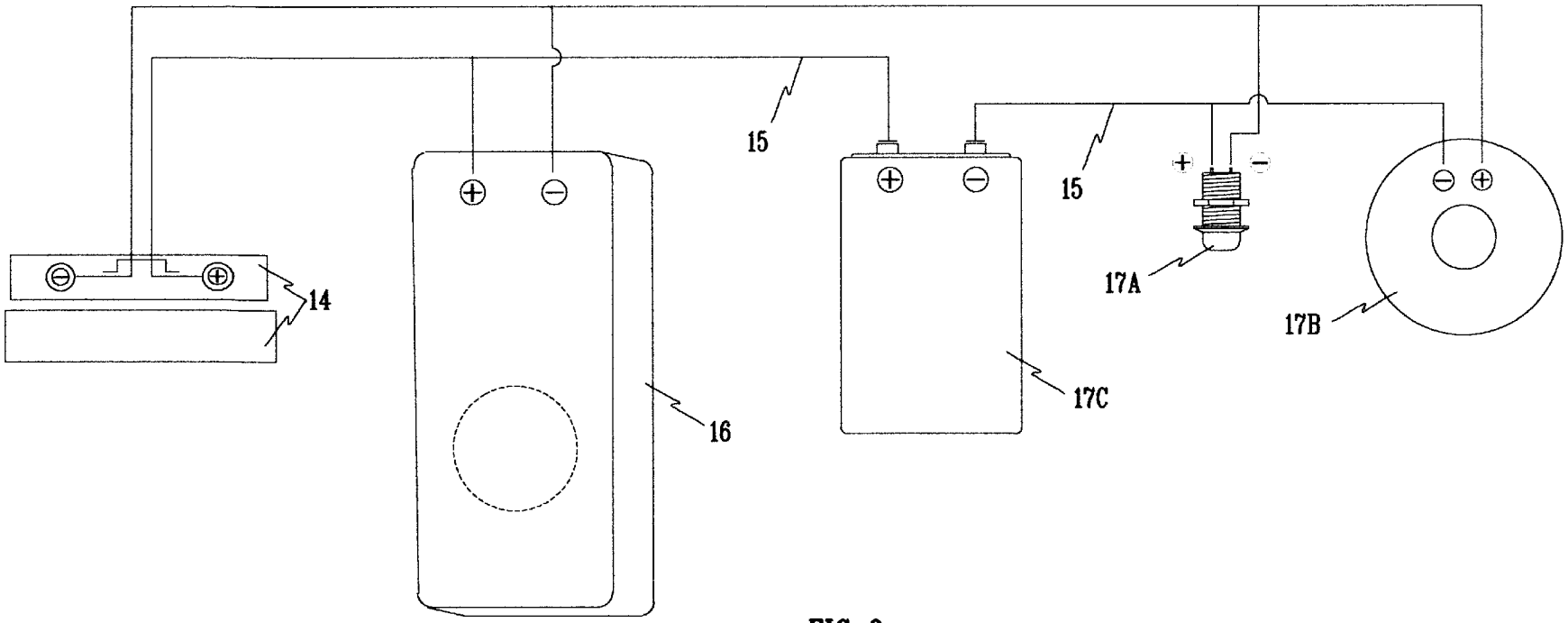
FIG. 9 is a circuit diagram showing in series the magnetic switch, a remote wireless alarm activator switch, a nine (9) volt DC battery, a visual alarm indicator light, and an electronic audible pulsating buzzer.

The newly invented T Hook (13C) is made from a single strand of metal wire or plastic approximately 15 centimeters long, bent or shaped in a rectangular fashion around the connecting strap approximately 3 centimeters on one side, bent 90 degrees on each end continuing for a distance of 5 millimeters on each end. Each end bends 90 degrees inward toward each other with each extending approximately 14 millimeters forming a rectangular shape with each side bending 90 degrees outward running parallel for 1.5 centimeters. Each side bends 45 degrees in opposite directions for approximately 8 millimeters with each side bending 45 degrees inward so each side extends parallel to the other for 2 centimeters. Each side then turns inward toward each other for 4 millimeters on each side with the 4 millimeter sides being inserted into two holes drilled into either side of the cover (14A, FIG. 7) of the standard magnetic switch (14, FIG. 7). The magnetic switch (14, FIG. 7) houses a solid magnetic cylinder which, when separated from the other half of the switch, opens the circuit and activates the alarm (FIG. 9).

Figure 3:
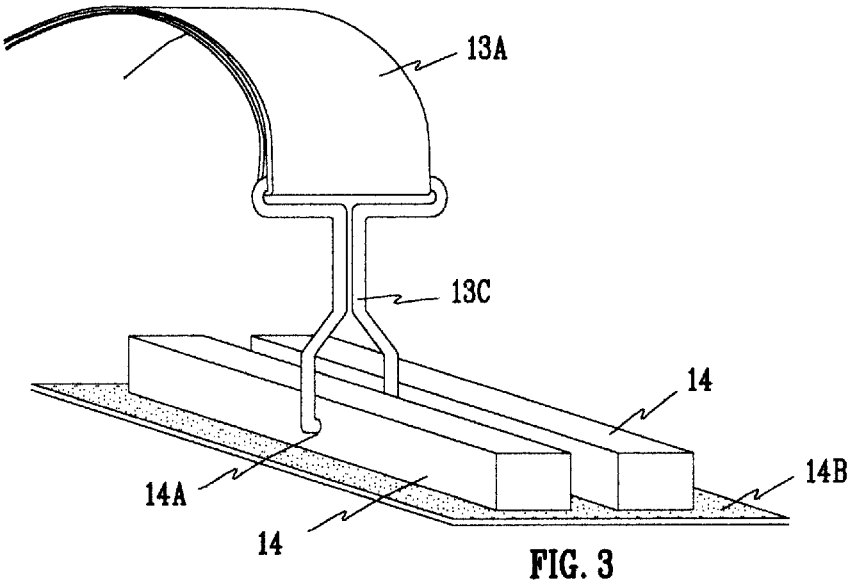
FIG. 3 is a perspective view of the magnetic switch in a closed position secured to Velcro and attached to the connecting apparatus.

Velcro (14B, FIG. 3) secures both sides of the magnetic switch (14, FIG. 3) in a closed position. The undersides of the magnetic switch (14, FIG. 7) have small strips of female Velcro affixed to it by an adhesive substance. The female surface of the Velcro attaches to a wider rectangular strip of male Velcro (14B, FIG. 7). Velcro (14B, FIG. 7) has an adhesive substance on the side that is affixed to the surface of a table or other stationary surface.

The hardwired visual and audible alarm is activated upon separation of the magnetic switch caused by forward or side movement of the person being monitored or an intentional call for assistance. Such movement causes the connecting strap (13A, FIG. 1) to separate the magnetic switch (14) which opens the magnetic switch and activates the hardwired audible and visual alarms (17,17A,17B, FIG. 9).

The opening of the magnetic switch completes the circuit sending the electronic signal by hardwire (15, FIG. 9) through the remote wireless alarm activator switch (16, FIG. 9) using a nine- (9) volt battery (17C, FIG. 9) as a power supply. The opened magnetic switch completes the hardwired circuit causing the remote wireless alarm activator switch (16, FIG. 9) to activate the remote audible and visual wireless door chime (18, FIG. 1, FIG. 11).

Figure 10:
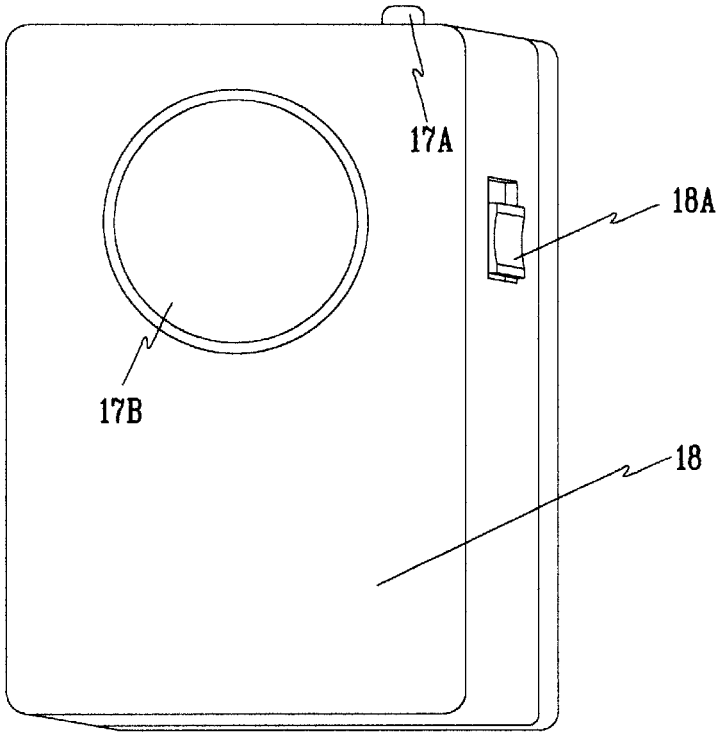
FIG. 10 is a perspective view of the front and side of the external cover of a wireless remote audible door chime device after modification to include a visual (light) alarm on top.
Figure 1:
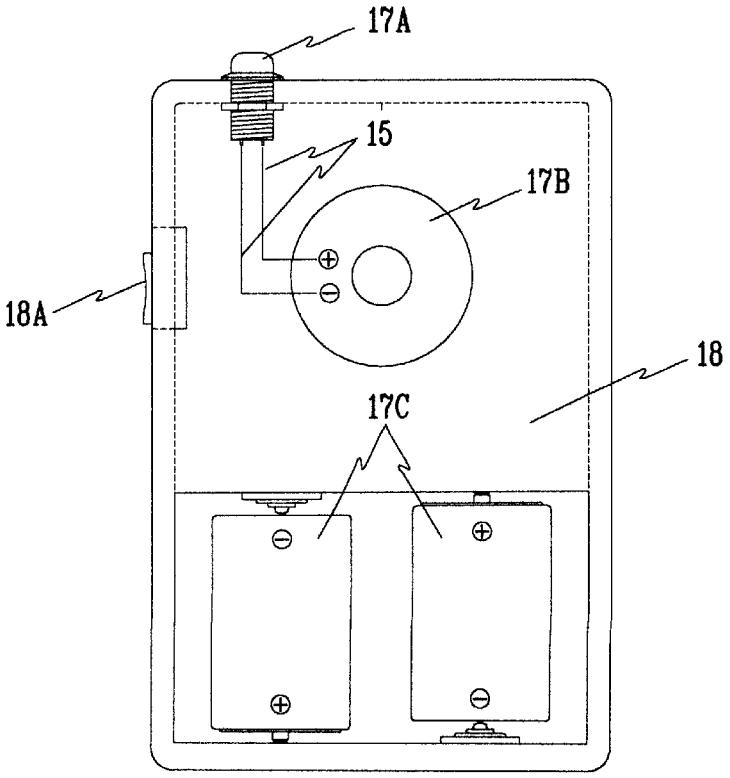

It is noted that a standard remote wireless door chime (18, FIG. 10) has been modified in this invention to include the addition of a visual indicator light (15,17A, FIG. 11) for the hearing impaired because present models of remote door chime systems do not provide visual alarm indicator features.

Another modification to the standard remote wireless door chime (18) is the addition of an adapter clip (18A, 18B, FIG. 12) which permits the caregiver to conveniently attach the remote wireless door chime to his/her belt or clothing (18, FIG. 1) while monitoring an individual from a remote location (garden, garage, etc.). The adapter clip (18B, FIG. 12) is 1.5 CM wide; 5 CM long and is made from metal, rubber or plastic. This adapter clip (18B) is inserted into a metal, rubber, or plastic pocket (18A, FIG. 12) that is affixed to the back of the remote alarm cover (18, FIGS. 10,12) by adhesive material (tape or glue) or screws.

The hardwired audible and visual alarm system can accommodate additional audible and visual monitoring units shown in (17, FIG. 1) if desired.

Figure 1:
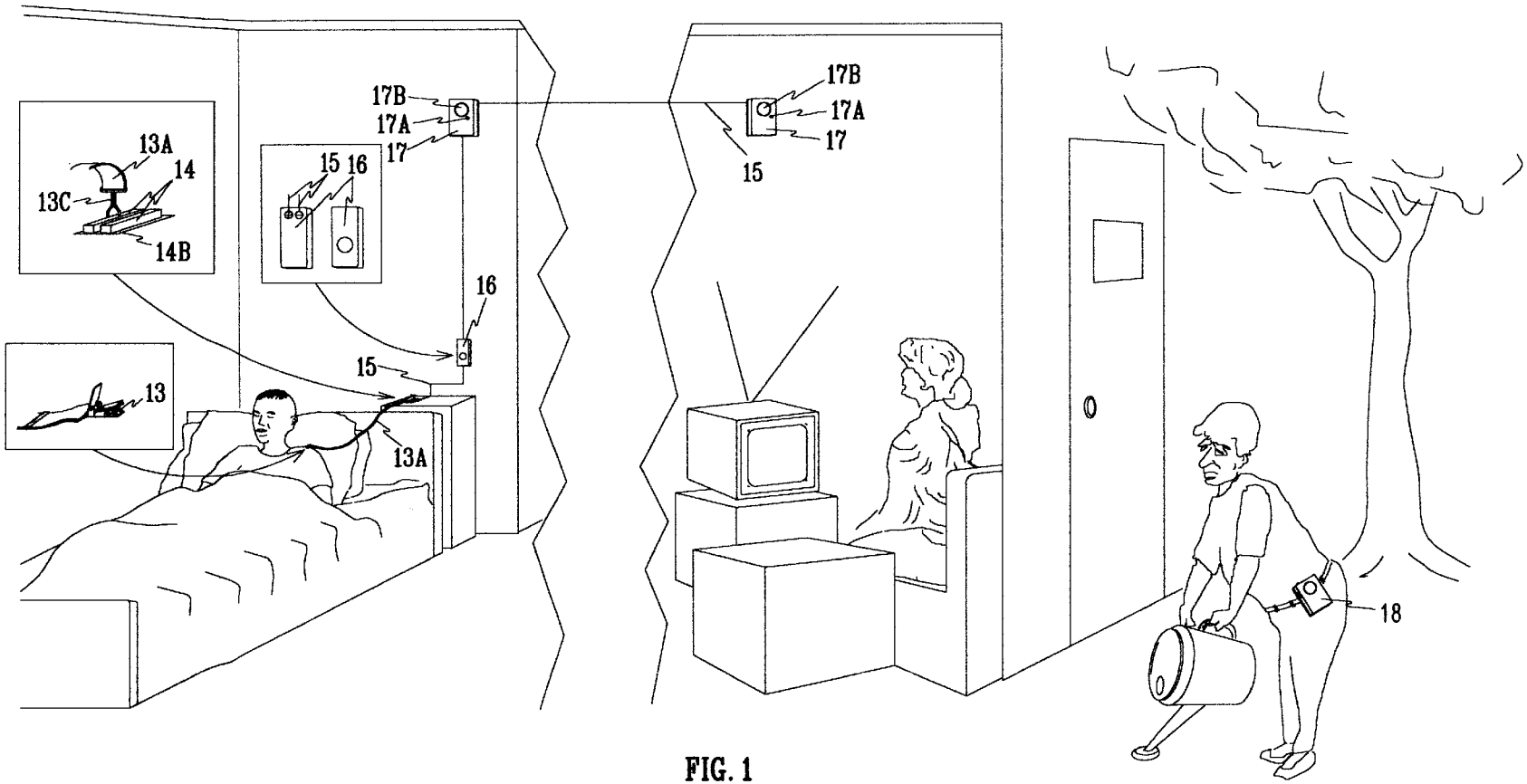
FIG. 1 is a sectional perspective view of two (2) separate rooms within a house and an outside garden view. Two (2) caregivers are shown monitoring an individual (one caregiver is inside the house using the hardwired audible and visual alarm device in an adjacent room and the other caregiver is outside the house using the remote wireless audible and visual alarm).
Figure 2:
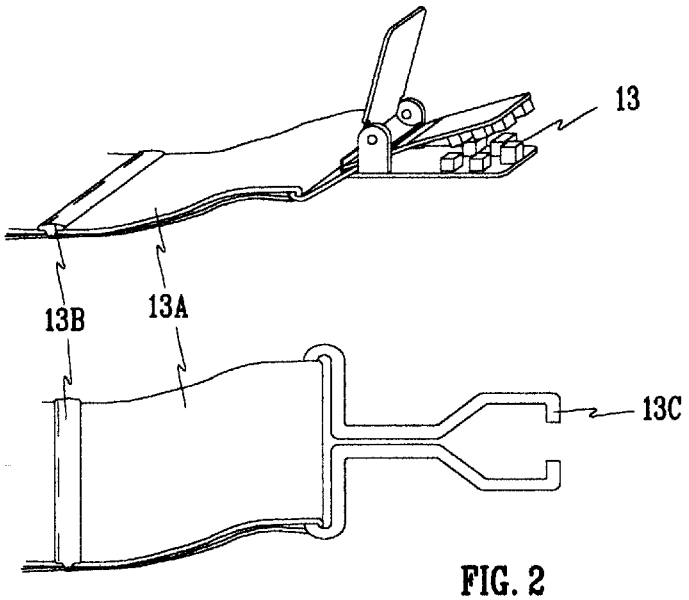
FIG. 2 is a prospective view of the connecting apparatus with two (2) adjustable clasps and fitted on one end with a standard clothing suspender fastener and fitted on the other end with a newly invented connector which attaches to the magnetic switch cover.
Figure 4:
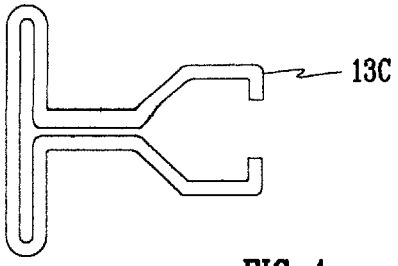
FIG. 4 is a plan view of the newly invented connector that attaches on one end to the connecting apparatus and the other end to the magnetic switch.
Figure 5:
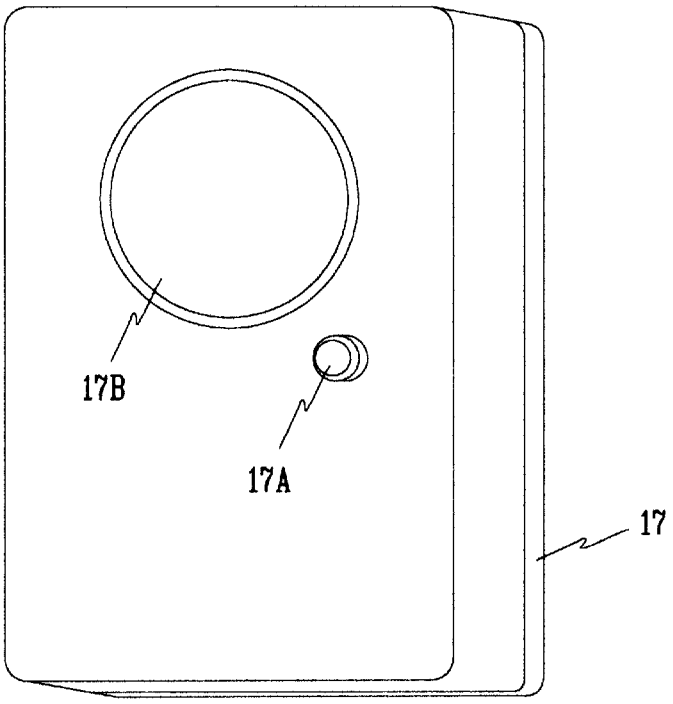
FIG. 5 is a perspective view of the front and side of the external cover of the hardwired audible and visual alarm device.
Figure 6:
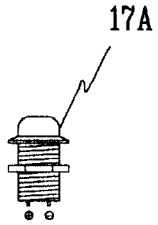
FIG. 6 is a detail view of a light bulb that signals a visual alarm in the hardwired alarm and remote chime device.
Figure 12:
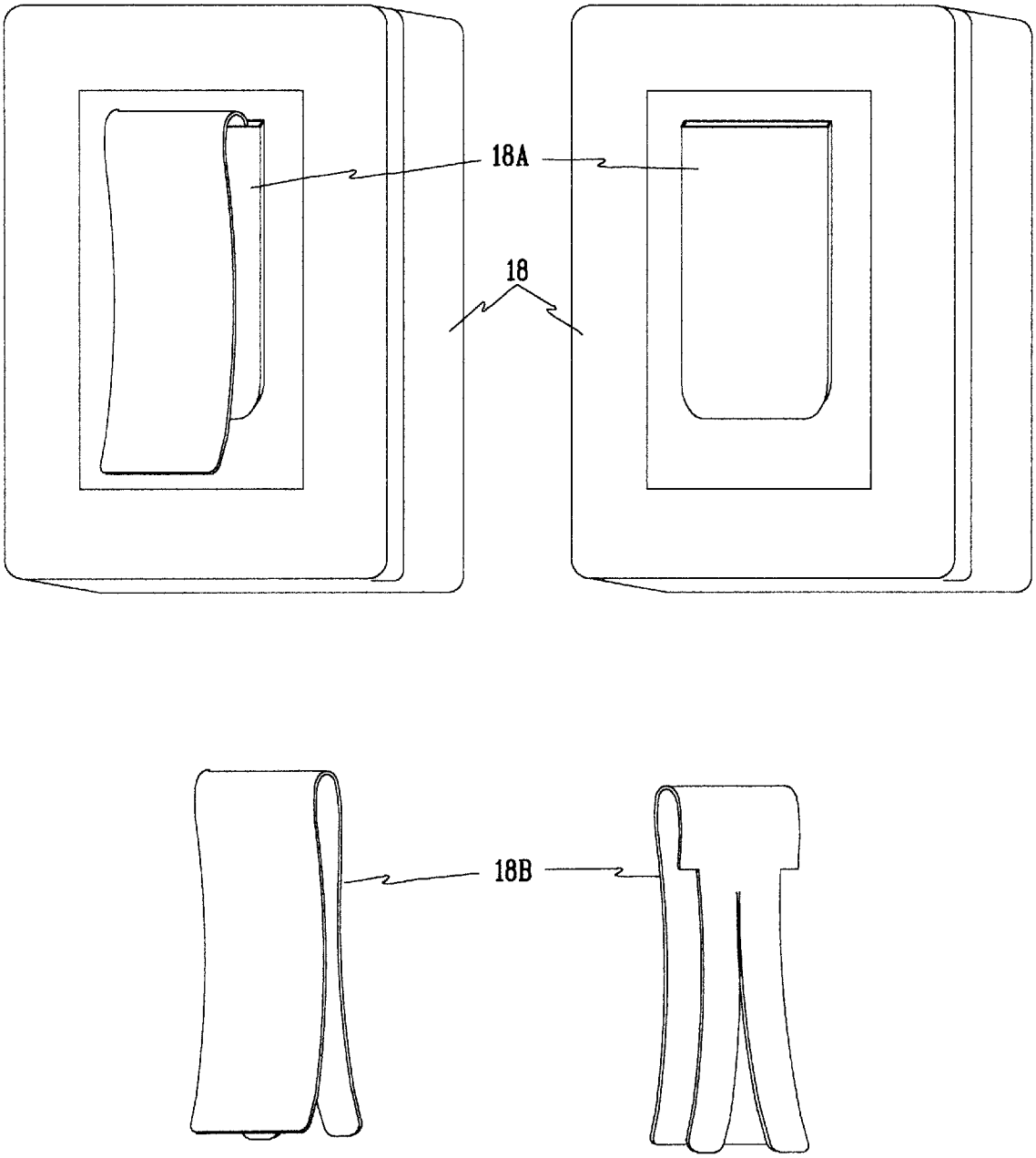
FIG. 12 is a perspective view of the back and side of the external cover of the remote audible and visual door chime device further modified to include a metal, rubber or plastic receptacle and adapter clip for attaching the remote door chime device to the caregiver's belt or clothing.

What I claim as my invention is:

1. An alarm device for monitoring an individual's movement and/or need for assistance by signaling unsafe motion between an individual and a second stable surface comprising a continuous non-elastic adjustable strap (13A, FIGS. 1,2), with a clothing suspender fastener (13, FIG. 2) on one end, attached to the individual's clothing being monitored (FIG. 1), and a T Hook (13C, FIG. 4) on the other end linked to a magnetic switch (14, FIG. 3), attached to the stable surface by material (14B, FIG. 3) offering sufficient resistance to undesirable disconnect or separation;

the adjustable strap (13A, FIG. 2), has on the end opposite the T Hook (13C, FIG. 4), the clothing suspender fastener (13, FIG. 2), an adjustable clothing suspender clasp (13B, FIG. 2), to allow for adjusting the length of the strap (13A, FIG. 1) connecting the individual being monitored and the magnetic switch (14, FIG. 1);

when an unsafe forward or side movement by the individual being monitored occurs, or the individual consciously separates the magnetic switch, this completes an electronic circuit, which activates a hard wired battery powered (17B, FIG. 9) audible and visual alarm (17A), which simultaneously activates an optional remote wireless chime activator switch (16, FIGS. 1,9), or a remote audible and visual chime device (18, FIGS. 1, 11), attached to the belt or clothing of a caregiver (18, FIG. 1) using a metal, rubber or plastic clip affixed to the back of a chime cover (18A, 18B, FIG. 12).

2. The device described in claim 1 wherein the magnetic switch (14) is altered by drilling two holes, on either side (14A, FIGS. 3,7), to accommodate the T Hook (13C, FIG. 4) which, when unsafe forward or side movement occurs causes the separation of the magnetic switch to activate and signal an alarm.

3. The alarm device of claim 1, wherein the continuous non-elastic adjustable strap is made of cloth, plastic or other material (13A, FIG. 1) to connect the magnetic switch (14) to the clothing of the individual being monitored (FIG. 1).

4. The alarm device of claim 1, wherein the T Hook (13C, FIG. 4) is specifically designed to join the continuous non-elastic adjustable strap (13A, FIG. 2) to the magnetic switch by inserting the connector into either side of modified magnetic switch cover holes (14A, FIG. 4).

5. The alarm device of claim 1, wherein a clothing suspender fastener or other metal or plastic apparatus (13, FIG. 2) is used to fasten the adjustable connecting strap (13A) between the magnetic switch (14), and the clothing of the individual being monitored (FIG. 1).

6. The alarm device of claim 1, wherein a clothing suspender adjustment clasp or other metal or plastic apparatus (13B, FIG. 2) is used to adjust the length of the connecting strap (13A, FIG. 2) between the magnetic switch (14, FIG. 1), and the clothing of the individual being monitored (FIG. 1).

7. The alarm device of claim 1, wherein an optional remote wireless activator switch (16, FIGS. 1,9) sounds and illuminates a remote audible and visual chime device (18, FIGS. 1, 11).

8. The alarm device of claim 7, wherein the remote wireless chime device is attached to the belt or clothing of the caregiver (18, FIG. 1), wherein the chime device's back cover includes a metal, rubber, or plastic clip (18B, FIG. 12) being affixed in a metal, rubber, or plastic receptacle (18A, FIG. 12) being attached to the cover by an adhesive material.

9. The alarm device of claim 1, wherein said hardwired battery powered audible and visual alarm comprises a DC battery powering an electronic buzzer and light bulb.

* * * * *